US006719486B2

(12) United States Patent
Craghan

(10) Patent No.: US 6,719,486 B2
(45) Date of Patent: Apr. 13, 2004

(54) APPARATUS FOR SCREEDING

(76) Inventor: Andrew D. Craghan, 1219 Minnehaha Trail, Manasquan, NJ (US) 07836

( * ) Notice: Subject to any disclaimer, the term of this patent is extended or adjusted under 35 U.S.C. 154(b) by 0 days.

(21) Appl. No.: 10/214,698

(22) Filed: Aug. 8, 2002

(65) Prior Publication Data

US 2004/0028473 A1 Feb. 12, 2004

(51) Int. Cl.[7] ..... E01C 19/22
(52) U.S. Cl. ..... 404/119; 33/405
(58) Field of Search ..... 404/118, 119, 404/120, 96, 97, 101, 103, 105, 72; 33/405, 406, 1 H; 52/155, 156, 159, 679, 678; 135/118

(56) References Cited

U.S. PATENT DOCUMENTS 1,592,681 A * 7/1926 Grothe ..... 52/365
1,838,635 A * 12/1931 Pilj ..... 52/678
1,852,673 A * 4/1932 Pilj ..... 52/678
1,939,007 A * 12/1933 Hetzel ..... 264/31
2,129,568 A * 9/1938 De Biasi ..... 52/678
2,262,704 A * 11/1941 Tompkins et al. ..... 404/95
2,319,526 A * 5/1943 Wearn ..... 52/678
2,331,949 A * 10/1943 Whiteman ..... 52/678
2,373,284 A * 4/1945 Autrey ..... 52/678
2,551,826 A * 5/1951 Cox, Sr. ..... 52/678
2,823,539 A * 2/1958 Kersh et al. ..... 52/678
2,867,041 A * 1/1959 McMillan ..... 33/228
2,873,529 A * 2/1959 Hogan et al. ..... 404/61
3,066,448 A * 12/1962 Pinter ..... 52/126.5
3,284,973 A * 11/1966 Ames et al. ..... 52/155
3,334,560 A * 8/1967 Long et al. ..... 404/84.2
3,451,179 A * 6/1969 Kendzia ..... 52/370
3,810,339 A * 5/1974 Russo ..... 52/700
3,921,356 A * 11/1975 Hughes ..... 52/299
4,158,937 A * 6/1979 Henry ..... 52/365
4,364,175 A * 12/1982 Levake et al. ..... 33/1 H
5,173,004 A * 12/1992 Fahrenkrog ..... 404/72
5,257,764 A * 11/1993 Spaulding ..... 248/125.1
5,301,485 A * 4/1994 Shaw et al. ..... 52/678
5,372,457 A * 12/1994 Rante ..... 405/119

* cited by examiner

*Primary Examiner*—Robert E. Pezzuto
*Assistant Examiner*—Alexandra K. Pechhold
(74) *Attorney, Agent, or Firm*—Robert M. Skolnik

(57) ABSTRACT

A screed where the installation is laid out with hollow ended pointed rods. The rods have markings on them to indicate the proper excavation depth for application s such as patio/walkway or d driveway. A grade pin or a jackhammer pin is inserted into the hollow ends of each rod to vertically position the rods to the proper elevation determined by surveying techniques. The pins are then replaced with U shaped rail supports. Rails are then inserted between supports. A screed board notched to ride on each rail is then used to smooth the surface of sub-base materials. Spacers in the form of hollow cylinders of a range of lengths are provided to adjust the height of the U shaped support, as required

5 Claims, 2 Drawing Sheets

APPARATUS FOR SCREEDING

BACKGROUND OF THE INVENTION

1. Field of The Invention

The present invention relates to an apparatus for screeding. A wooden or metal manual screed board, which is notched on both ends, rides on rails, which are placed in U-channels. The invention includes hollow topped supporting pipes, which are located at a desired height above the grade. Grade pins are then inserted into the hollow tops of each pipe. The pipes and the grade pins are then hammered downward until the top of the grade pin is at the desired finished proper elevation. The grade pins are then removed and the U-channels are then dropped into the pre-located pipes. Because of the dimensions of all components, the rails are supported a desired height above grade so that using the screed board on the rails produces a surface with not only the required smoothing and depth, but also one of the required slope. The heights of the U-channels can be adjusted using pipe spacers.

2. Description of the Related Art

Screeds of various configurations are known in the prior art.

Chambers, U.S. Pat. No. 413,846, discloses a road grader with an elongated board 10, which is manually pulled on trucks riding on rails.

Thorson, U.S. Pat. No. 1,832,951, shows a machine for troweling concrete paving.

Tamblyn, U.S. Pat. No. 2,306,671, discloses a screed, which rides in rails supported by C-channels mounted in pipe holders. The rails or runways 16 are best shown in FIGS. 5–7. At page 2, right hand column, lines 8–11, it is the level of the runways 16 which determine the level of the screed.

Kubula, U.S. Pat. No. 3,182,572 is a concrete belting machine. The device rides on rails, which are embedded in the ground.

Samprey, et al., U.S. Pat. No. 4,289,421 show a road screed incorporating an auger and a vibrator.

Morrison, U.S. Pat. No. 4,386,901, and Morrison, U.S. Pat. No. 4,701,071 disclose motorized two screeds which do not require guide rails.

U.S. Pat. No. 6,223,495, Shaw, et al. issued May 1, 2001, FIG. 3, shows a screed post assembly having a C shaped support for a rail 28. The C shaped support has a number of apertures 52 for changing the position of the rail 28 in the support.

Holmes U.S. Pat. No. 5,924,818 issued Jul. 20, 1999 teaches that changing the slope in a screed and a structure for accomplishing such a change.

Other patents are U.S. Pat. Nos. 6,273,636; 6,238,134; 6,056,474; 5,980,154; and U.S. Pat. No. 5,567,075.

These prior art devices are generally characterized by mechanical complexity in structure and in design.

SUMMARY OF THE INVENTION

The apparatus of the present invention is used, for example, in the installation of interlocking concrete pavers. Installation of such pavers involves the requirement to excavate the site to depths dependent on the type of underlying soil and the purposes for which the pavers are to be used. One commercial manufacturer recommends excavation of 7"–8" in sandy soil for sidewalks/patios and 11"–12" on clay. The depths are increased to 11"–12" on sandy soil for driveways and 15"–16" on clay. Slope and grade have to be established. The same manufacturer recommends a 1" elevation drop for every 34 feet for drainage. Slope for specific locations is usually determined by qualified engineers. Layers of sub-base material and sand are located in the excavated site. The sub-base material is compacted to a level within 3" from the finished height. The finished sub-base material must reflect the final grade. Sand is placed on the sub-base material. Both the sub-base material and the sand are smoothed by a screed. All of the dimensions of the installation are laid out with a transit or a sight level elevator, stakes and string.

The present invention eliminates the need for stakes and string to establish elevation. The installation is laid out with hollow ended pointed rods. The rods have markings on them to indicate the proper height for patio/walkway and driveway. Grade pins or jackhammer pins are inserted into the hollow ends of each rod to vertically position the rods to the proper markings. The pins are then replaced with U shaped rail supports. Rails are then inserted between supports. A screed board notched to ride on each rail is then used to smooth the surface of the sub-base material and the sand layer. Spacers in the form of hollow cylinders of a range of lengths are provided to adjust the height of the U shaped support, as required. For example, if the industry standard requires a 1" sand layer over the sub-base, use of a 1" spacer will produce the required 1" sand layer.

A principal object and advantage of the invention is the provision of a method and apparatus for manual screeding.

Another object and advantage of the invention is the provision of a supporting base for mechanical as well as manual screed devices.

Another object and advantage of the invention is the provision of a screed, which also eliminates the need for use of string and stake to provide proper elevations.

A still further object of the invention is the provision of a screed, which includes grade or jackhammer pins, which located in hollow support rods so that the height of the resultant screed is within required tolerances.

Another object and advantage of the invention is the provision of a screed where grade or jackhammer pins are also used to prevent damage to the hollow support rods when the rods are hammered into place.

Another object and advantage of the invention is the provision of screed, which provides a plurality of different fine height adjustments by using different length hollow cylinders placed beneath the screed board supports.

A still further object and advantage of the invention is the provision of a screed system, which is inexpensive and easy to use.

The foregoing, as well as further objects and advantages of the invention will become apparent to those skilled in the art from a review of the following detailed description of my invention, reference being made to the accompanying drawings.

DETAILED DESCRIPTION OF THE PREFERRED EMBODIMENT

Figure 1:
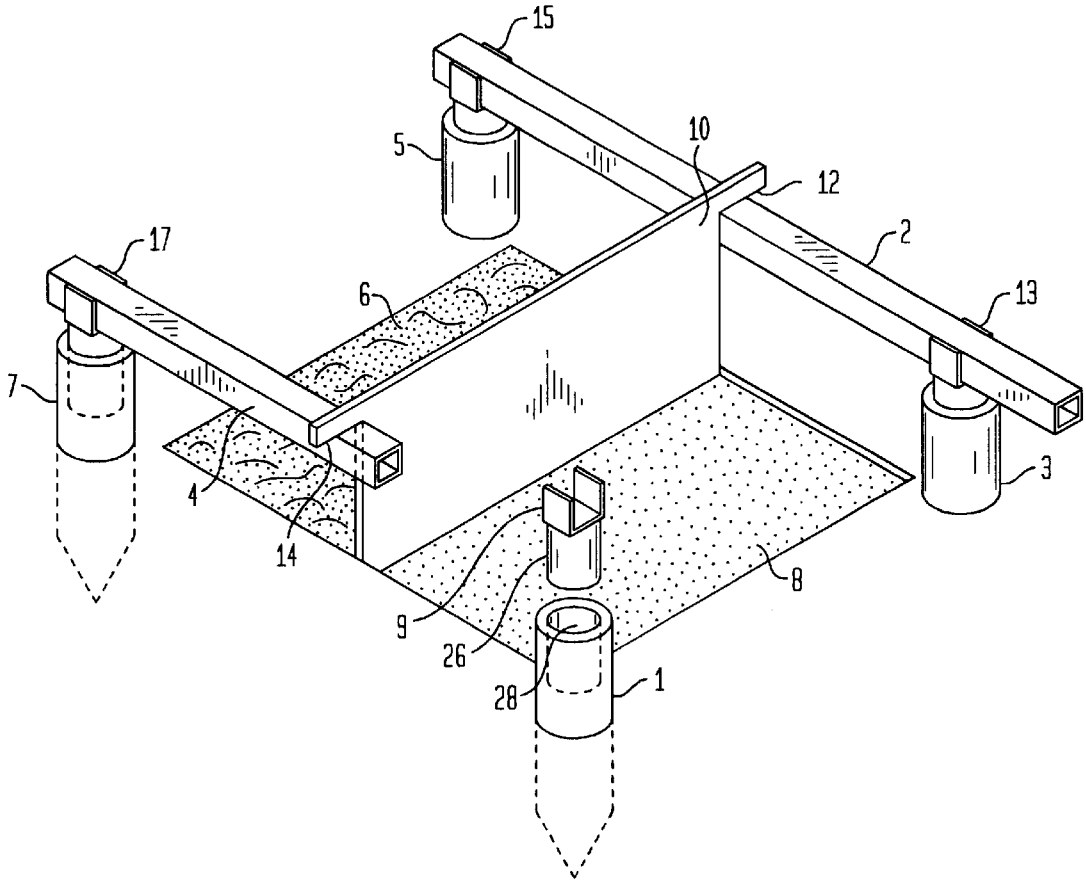
FIG. 1 is a perspective view of my invention in use.

As shown in FIGS. 1–5, where like reference numerals are used to designate like parts, the a manually moveable screed board 10 is notched 14, 12 at both its ends to ride on rails 4 and 2, respectively. The rails are supported between at least two U-shaped supports 9 and 17 for rail 4 and 13, 15 for rail 2. The U-shaped supports are, in turn, mounted in respective cylindrical tapered support rods 3, 5, 7 and 11. Each support rod has an aperture 28 drilled therein to receive a mounting portion 26 of the U-shaped support.

As is known, screed board 10 is passed over rough surface 6 to smooth it producing a smooth surface 8.

Figure 2:
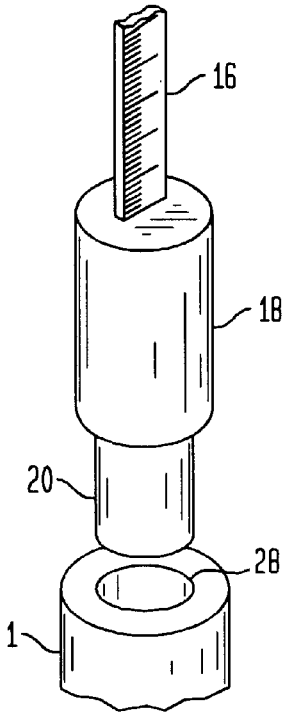
FIG. 2 is a perspective view of the grade pin.
Figure 3:
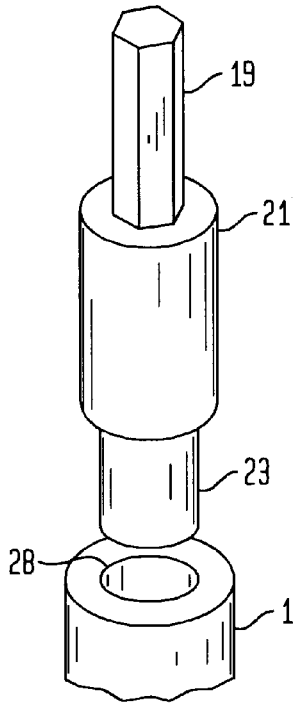
FIG. 3 is a perspective view of the jackhammer pin.
Figure 4:
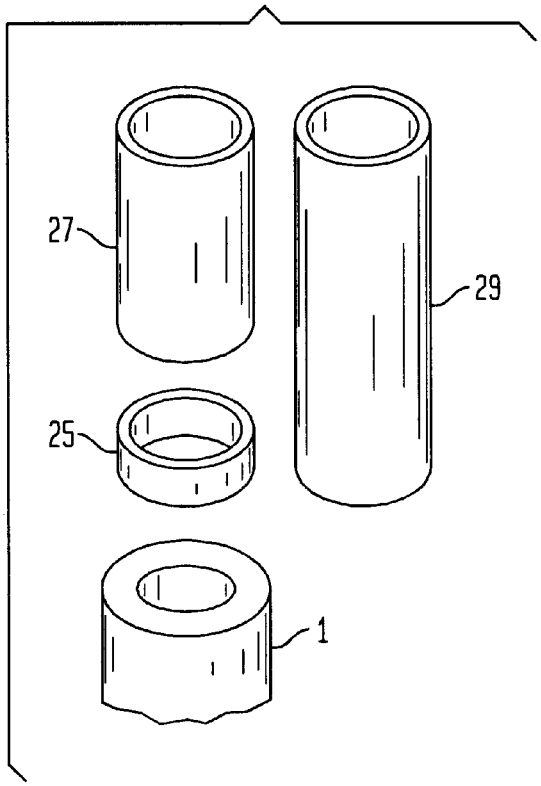
FIG. 4 is a perspective view of pipe spacers.

Three accessories to the system of FIG. 1 are shown in FIGS. 2–4. FIG. 2 is grade pin, which aids in positioning each of the cylindrical tapered support rods at the correct height. The grade pin includes a cylindrical large diameter portion 18 connected to a smaller diameter portion 20, which fits into the circular aperture 28 in support rod 1. In use, the grade pin is inserted into the support rod and the pin and rod is hammered until the top of the grade pin is at the desired finished paver elevation. Elevation may be established using a transit rod 16 or the markings described in FIG. 5, or both. The height of the grade pin portion 18 is such that when it is removed from the support rod 1 and replaced by the U-shaped support 9, the screed board support rails will be at the correct height for the required paver elevation.

FIG. 3 is a perspective view of the jackhammer pin used in the invention. Use of a jackhammer is often required to position the support rods. A pin has a portion 19 shaped to fit into the head of a jackhammer. A large diameter collar 21 serves to limit the travel of the portion 19 into the jackhammer as well as take up the forces of the jackhammer on the support rod. A portion 23 is connected to the collar 21 to fit into the aperture 28 in support rod 1. The length of the portion 19 and .the thickness of the collar are such that, when positioned at the correct elevation using transit 16 or the markings described in connection with FIG. 5, or both, then the U-shaped rail supports will support the rail at the proper screed board elevation when the jackhammer pin is replaced by the U-shaped rail support.

FIG. 4 shows spacers 25, 27, and 29 of different lengths, which are useable to position the U-shaped supports above the top of the support rods. A spacer of appropriate length is selected and placed on top of the support rod. The shaft of a U-shaped support is then placed through spacer into the aperture of the support rod. These spacers serve as a fine height adjustment for the screed board.

Figure 5:
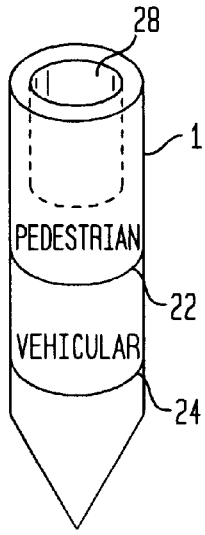
FIG. 5 is a perspective view of a tapered support with depth markings.

FIG. 5 is a perspective view of a grade pin having required excavation depth markings 22 and 24 imprinted thereon. Numeral 22 is the depth marking for pedestrian applications. Numeral 24 denotes the excavation depth for vehicular traffic. As discussed above, more material, thus greater excavation depth, is required for vehicular applications than for pedestrian applications.

In use, as many of the support rods such as 1, 3, 5 and 7 are located in the configuration of the paver stone layout. It is to be understood what white only four rods have been shown, more than four rods are expected to be used in most layouts. The rods are then hammered into place using the grade pin of FIG. 2 or positioned with a jackhammer using the jackhammer pin of FIG. 3. The height of the tops of the support rods is determined with the use of a transit rod 16 to establish the slope of the resulting installation. The grade pin and/or the jackhammer pins are removed and replaced with the rail supports 9, 13, 15, and 17. The rail 24 is then put in place and the screed board 10 is ready for use. The cylindrical shape of the aperture 28 and the portion 26 of the U-shaped support allows the U-shaped support to be positioned anywhere in the full 360° circumference of the aperture 28.

While specifically described as used in the installation of interlocking pavers and with a manual screed board, it is to be understood that the apparatus described herein may be used anywhere screeding of granular materials is required and that machine powered screeds may also be supported by the rails described herein.

Further modifications to the apparatus of the invention may be made without departing from the spirit and scope of the invention; accordingly, what is sought to be protected is set forth in the appended claims.

What is claimed is:

1. A screed for a paver stone installation comprising a plurality of tapered support rods having depth markings thereon indicative of the required excavation depth for different applications, each rod having an aperture formed in one end thereof; pin means having a first portion connected in said aperture and a second portion for absorbing a hammer blow to affix said tapered support rods in the ground; U-shaped rail support means connected in said aperture after said pin means is removed for supporting a portion of a rail; a rail mounted in adjacent U-shaped rail support means each connected in respective ones of said apertures; and a screed board for riding on said rails; the elevation of said second portion of said pin means being the same as the elevation of a paver stone such that when said tapered support rods are positioned in accordance with said markings, said rails will be positioned at the correct elevation for the amount of screed material required and the elevation of the finished paver stones will also be established.

2. The screed of claim 1 wherein said U-shaped rail support means is connected in said aperture so that it may rotate 360° in said tapered support rods.

3. The screed of claim 1 further including a plurality of different length spacers for adjusting the elevation of said U-shaped rail supports for establishing the amount of material required for further screed layers.

4. The screed of claim 3 wherein said spacers are hollow cylinders.

5. A screed system for paver stones comprising a screed board having notches at both ends; two rails for supporting said screed board on said notches; U-shaped rail support means for supporting said rails; tapered rods connected to said U-shaped rail supports said tapered rods being affixed in the ground, pin means for positioning said tapered rods to the correct depth in the ground for the first layer of screed material before connection of said U-shaped rail supports to said tapered rods, the length of said pin means being the same as the elevation of a paver stone so that the elevation of the finished installation is established.

* * * * *